US007762485B2

(12) United States Patent
Huang

(10) Patent No.: US 7,762,485 B2
(45) Date of Patent: Jul. 27, 2010

(54) SWINGING PAPER CHIP DISTRIBUTING MECHANISM AT PAPER OUTLET OF SHREDDER

(75) Inventor: Simon Huang, SanChung (TW)

(73) Assignee: Michilin Prosperity Co., Ltd., SanChung City, Taipei Hsien (TW)

( * ) Notice: Subject to any disclaimer, the term of this patent is extended or adjusted under 35 U.S.C. 154(b) by 322 days.

(21) Appl. No.: 11/797,397

(22) Filed: May 3, 2007

(65) Prior Publication Data

US 2008/0156914 A1 Jul. 3, 2008

(30) Foreign Application Priority Data

Dec. 22, 2006 (TW) ..... 95222586 U

(51) Int. Cl.
*B02C 4/32* (2006.01)
*B02C 11/08* (2006.01)

(52) U.S. Cl. ..... 241/100; 241/236; 241/186.3

(58) Field of Classification Search ..... 241/100, 241/236, 186.3
See application file for complete search history.

(56) References Cited

U.S. PATENT DOCUMENTS

| | | | | |
|---|---|---|---|---|
| 3,137,332 | A * | 6/1964 | Gronberg | 241/186.3 |
| 3,333,617 | A * | 8/1967 | Hohlfeld et al. | 241/186.3 |
| 5,016,828 | A * | 5/1991 | Utsumi et al. | 241/158 |
| 6,550,701 | B1 * | 4/2003 | Chang | 241/36 |
| 7,014,133 | B2 * | 3/2006 | Ho | 241/36 |
| 2007/0145170 | A1 * | 6/2007 | Easton et al. | 241/100 |

* cited by examiner

*Primary Examiner*—Bena Miller
(74) *Attorney, Agent, or Firm*—Bacon & Thomas, PLLC

(57) ABSTRACT

A shredder holds a cutting blade assembly including a motor and a gear box inside its case and has a trash bin for collecting paper chips underneath the cutting blade assembly. A swinging board is provided in the vicinity of the paper outlet of the case. The swinging board is connected to a transmission axis via a shaft. One end of the transmission axis has a passive gear for receiving the rotating power from the cutting blade assembly via gears. As the transmission axis turns, the swinging board is driven by the shaft to perform a reciprocal motion so that the paper chips falling from the blades are evenly distributed over the trash bin. Paper chips accumulate in an even way to maximize the space in the trash bin. This prevents the formation of chip mountain and thus the problem of paper jams.

3 Claims, 3 Drawing Sheets

SWINGING PAPER CHIP DISTRIBUTING MECHANISM AT PAPER OUTLET OF SHREDDER

BACKGROUND OF THE INVENTION

1. Field of Invention

The invention relates to a shredder and, in particular, to a swinging paper chip distributing mechanism for the shredder. As the blade axes rotate, a swinging board swings back and forth so that paper chips falling from the blades are evenly distributed over the trash bin. Paper chips accumulate in an even way to maximize the space in the trash bin. This prevents the formation of chip mountain and thus the problem of paper jams.

2. Related Art

As is well known, the action principle of a shredder for shredding paper is to dispose several cutting blades on two rotary shafts with spacers in between. A motor and a gear box are employed to drive the two parallel rotary shafts that rotate in opposite directions. They provide a shearing force on passing paper to cut it into small stripes. According to the mechanical cutting type, shredders can be classified as stripe-cut shredders and cross-cut shredders. In the former case, the cutting blades are disposed regularly on the rotary shafts and cut the paper along the longitudinal direction into long stripes. Each blade in the latter case has several hook-shaped cutting edges. The blades are disposed in a spiral way on the rotary shafts. In this case, the paper is not only cut along the longitudinal direction into stripes, but also cut in the transverse direction into chips.

In the case of either stripe-cut shredders or cross-cut shredders, they are usually sold with a trash basket or bin for holding trash paper. As described before, the cutting blades on two parallel and oppositely rotating blade axes of the shredder are driven by motor and gear box to cut paper passing through them. The paper stripes or chips then fall into the trash bin via a paper outlet at the bottom of the shredder. As the paper chips accumulate underneath the paper outlet, a so-called chip mountain forms. Once the chip mountain reaches a height close to the bottom of the paper outlet, it may prevent subsequent paper chips from falling into the trash bin. It may even happen that the paper chips are jammed in the spaces between the blades. This will affect the normal operations of the shredder.

Experiences show that once the chip mountain forms, the user can simply use his/her hand to flatten it for both enlarging the holding space and preventing the formation of chip mountain. Therefore, the problem of paper jam can be easily avoided.

SUMMARY OF THE INVENTION

An objective of the invention is to provide a paper chip distributing mechanism in which a swinging board swings back and forth as the blade axes rotate, so that paper chips falling from the blades are evenly distributed over the trash bin. Paper chips accumulate in an even way to maximize the space in the trash bin. This prevents the formation of chip mountain and thus the problem of paper jams.

To achieve the above objective, the disclosed shredder holds a cutting blade assembly including a motor and a gear box inside its case and a trash bin for collecting paper chips underneath the cutting blade assembly. A swinging board is provided in the vicinity of the paper outlet of the case. The swinging board is connected to a transmission axis via a crank arm. As the transmission axis turns, the swinging board is driven by the shaft to perform a reciprocal motion.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
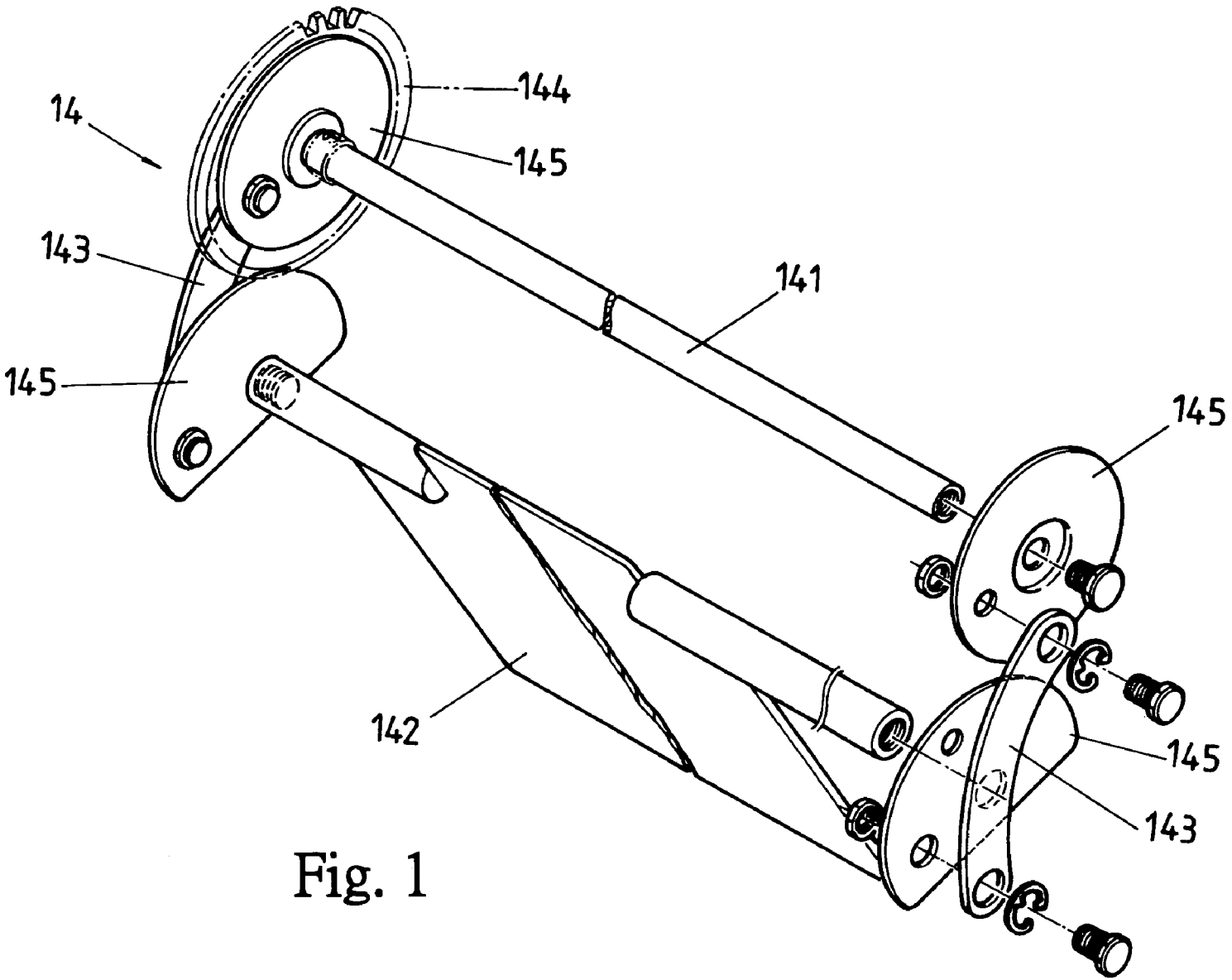
FIG. 1 is an exploded view of the structure of the disclosed paper chip distributing mechanism.
Figure 2:
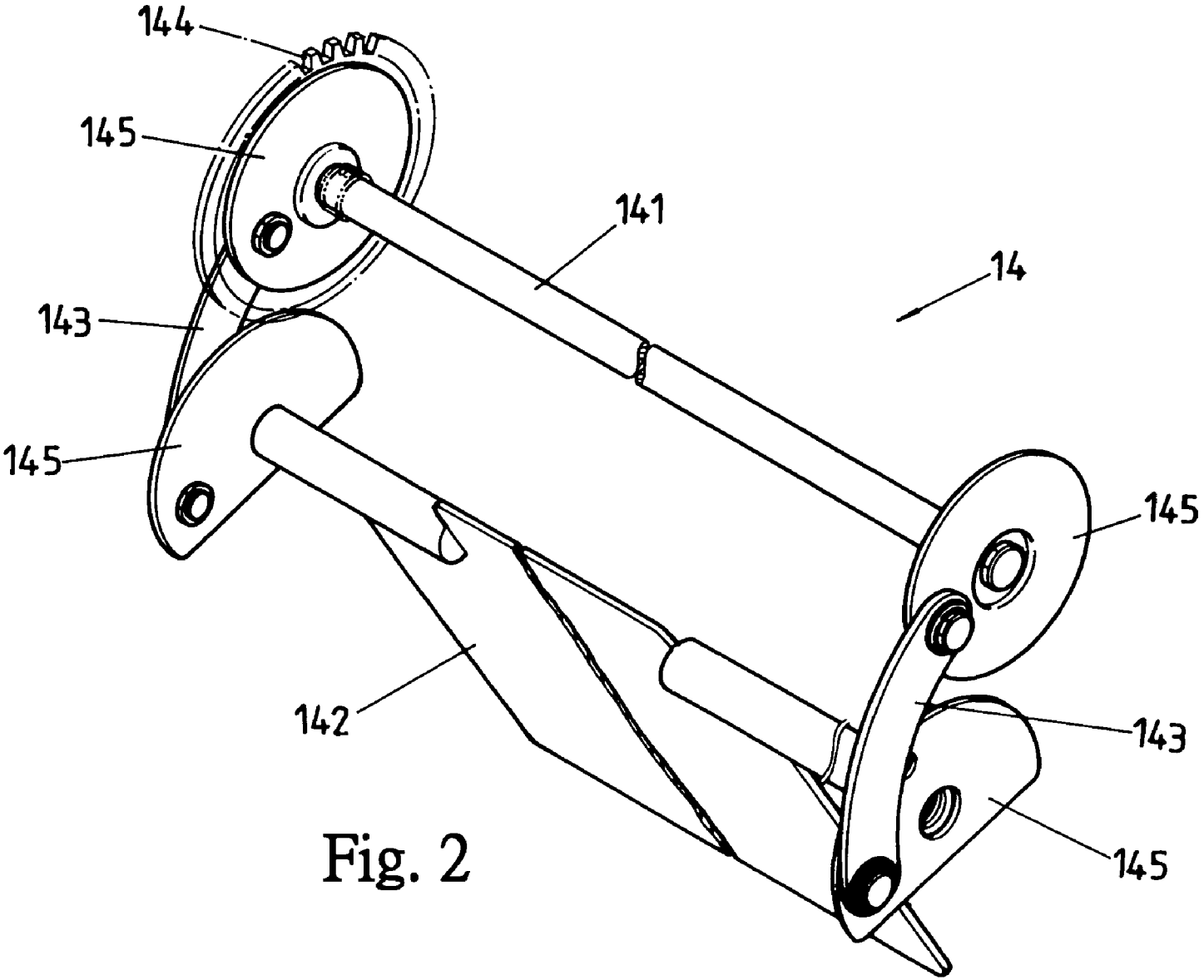
FIG. 2 is a three-dimensional view of the appearance of the disclosed paper chip distributing mechanism.
Figure 3:
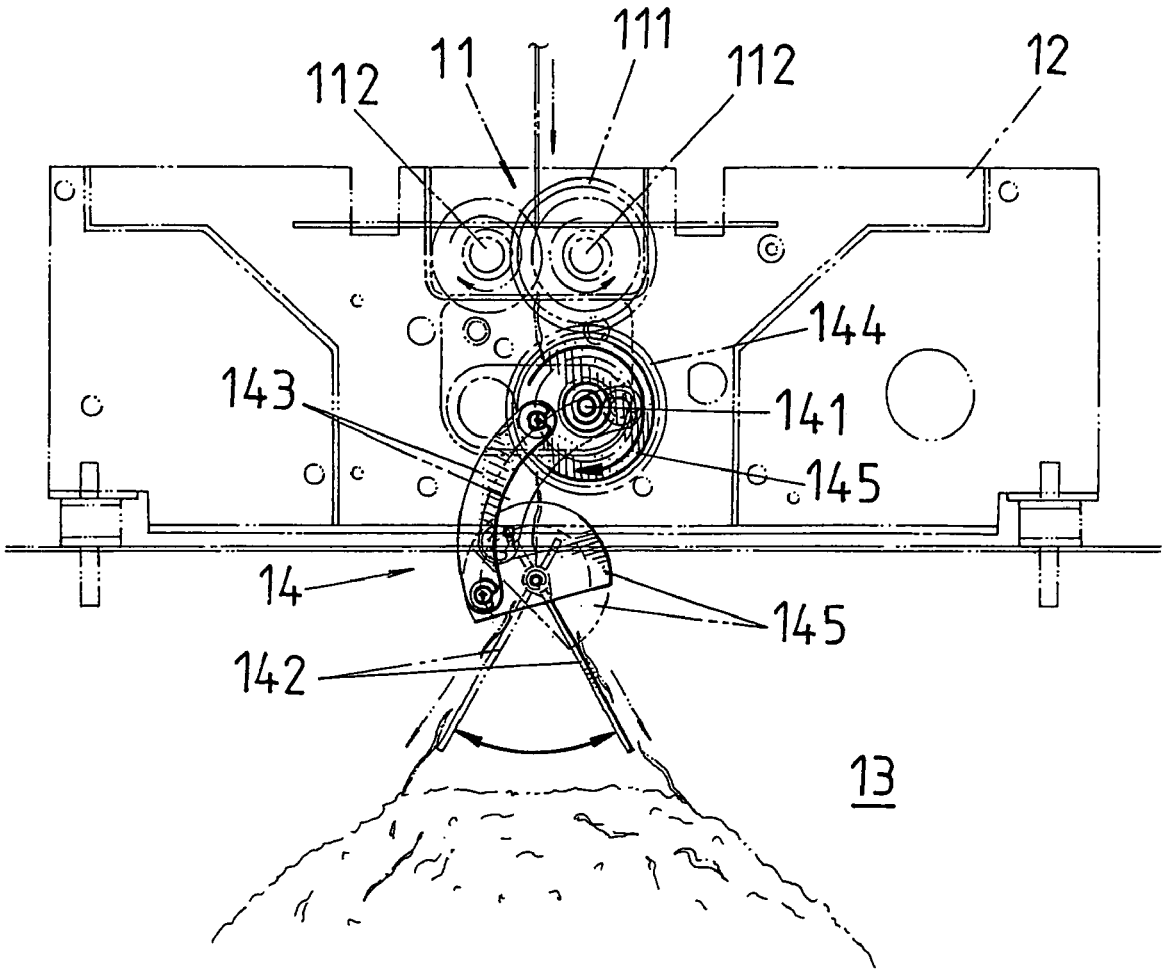
FIG. 3 is a schematic view showing how the disclosed swinging board functions.

FIG. 1 is an exploded view of the structure of the disclosed paper chip distributing mechanism. FIG. 2 is a three-dimensional view of the appearance of the disclosed paper chip distributing mechanism. FIG. 3 is a schematic view showing how the disclosed paper chip distributing mechanism functions.

The invention basically comprises a cutting blade assembly 11 including a motor and a gear box, a case 12 for holding the cutting blade assembly 11, a trash bin 13 for collecting paper chips, and a paper chip distributing mechanism 14.

The cutting blade assembly 11 uses its motor to drive two parallel and oppositely rotating blade axes 112 via the gear box 111. Passing paper is cut by the blades into stripes or chips. The paper chips all fall into the trash bin 13 underneath the cutting blade assembly 11.

The paper chip distributing mechanism 14 further includes a transmission axis 141 and a swinging board 142. One end of the transmission axis 141 receives a rotating power from the transmission gear 111 of the blade axes 112 via a passive gear 144. The swinging board 142 is connected with the transmission axis 141 via the crank arm 143. Both ends of the swinging board 142 and the transmission axis 141 are provided with connecting boards 145. When the transmission axis 141 rotates, the swinging board 142 is driven by the crank arm 143 to perform a reciprocal motion. The paper chips falling from the blade axes 112 are evenly distributed by the swinging board 142 over the trash bin 13. Paper chips accumulate in an even way to maximize the space in the trash bin. This prevents the formation of chip mountain and thus the problem of paper jams.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A shredder which comprises:

a cutting blade assembly, which includes a motor, a gear box, and rotating blade axes;

a case, which holds the cutting blade assembly;

a trash bin, which is disposed underneath the case for collecting paper chips falling from the cutting assembly; and a paper chip distributing mechanism, which is disposed under the cutting blade assembly and arranged to perform a reciprocal motion in response to rotation of the rotating blade axes by the motor to evenly distribute falling paper chips over the trash bin, wherein the paper chip distributing mechanism further includes a transmission axis and a swinging board that carries out said reciprocal motion, and wherein the transmission axis is connected to the cutting blade assembly by a passive gear for receiving rotating power from the cutting blade assembly.

2. A shredder which comprises:

a cutting blade assembly, which includes a motor, a gear box, and rotating blade axes;

a case, which holds the cutting blade assembly;

a trash bin, which is disposed underneath the case for collecting paper chips falling from the cutting assembly; and a paper chip distributing mechanism, which is disposed under the cutting blade assembly and arranged to perform a reciprocal motion in response to rotation of the rotating blade axes by the motor to evenly distribute falling paper chips over the trash bin, wherein the paper chip distributing mechanism further includes a transmission axis and a swinging board that carries out said reciprocal motion, and wherein the swinging board is connected to the transmission axis via a crank arm.

3. The shredder of claim 2, wherein both ends of the swinging board and the transmission axis are provided with connecting boards for the two ends of the shaft to be fixed thereon, and as the transmission axis rotates the swinging board is driven by the crank arm to perform the reciprocal motion.

* * * * *